United States Patent [19]

Woodcock et al.

[11] Patent Number: 4,796,593

[45] Date of Patent: Jan. 10, 1989

[54] TANK MOUNTED VALVE FOR FUEL VAPOR RECOVERY SYSTEM

[75] Inventors: William F. Woodcock, Dearborn, Mich.; Loren H. Kline, Oregon, Ohio

[73] Assignee: Colt Industries Inc., New York, N.Y.

[21] Appl. No.: 109,194

[22] Filed: Oct. 16, 1987

[51] Int. Cl.[4] ..... F02M 39/00

[52] U.S. Cl. ..... 123/518; 123/516; 123/520

[58] Field of Search ..... 123/516, 514, 518, 520, 123/521

[56] References Cited

U.S. PATENT DOCUMENTS

| | | | |
|---|---|---|---|
| 3,302,658 | 2/1967 | DeFrees | 123/516 |
| 3,606,908 | 9/1971 | Riester | 123/516 |
| 3,610,221 | 10/1971 | Stoltman | 123/518 |
| 3,616,783 | 11/1971 | Masters | 123/518 |
| 3,617,034 | 11/1971 | Skinner | 123/518 |
| 3,662,725 | 5/1972 | Dragon | 123/518 |
| 3,703,165 | 11/1972 | Hansen | 123/518 |
| 3,957,025 | 5/1976 | Heath | 123/518 |
| 4,178,894 | 12/1979 | Nay | 123/518 |
| 4,646,701 | 3/1987 | Fukumoto | 123/516 |

FOREIGN PATENT DOCUMENTS

| | | | |
|---|---|---|---|
| 2406843 | 8/1974 | Fed. Rep. of Germany | 123/518 |
| 0044444 | 4/1981 | Japan | 123/518 |

*Primary Examiner*—Carl S. Miller

*Attorney, Agent, or Firm*—Walter Potoroka, Sr.

[57] ABSTRACT

An onboard fuel vapor recovery system for a motor vehicle includes a pressure responsive valve mounted directly on the vehicle fuel tank to control the flow of fuel vapor from the tank to a vapor storage canister both during normal operation of the vehicle and during a vehicle refueling operation. A pressure responsive diaphragm in the tank mounted valve opens a substantially unrestricted vapor flow passage from the head space of the tank to the canister when the head space pressure slightly exceeds atmospheric pressure. A separate passage in the tank valve equalizes pressure in the tank head space upon the withdrawal of fuel. A float valve responsive to the level of fuel within the tank seals the vapor passage from the tank head space when the tank is filled with fuel and further incorporates an emergency tank pressure relief valve operable in the event of overfilling of the tank.

10 Claims, 1 Drawing Sheet

TANK MOUNTED VALVE FOR FUEL VAPOR RECOVERY SYSTEM

BACKGROUND OF THE INVENTION

Figure 1:
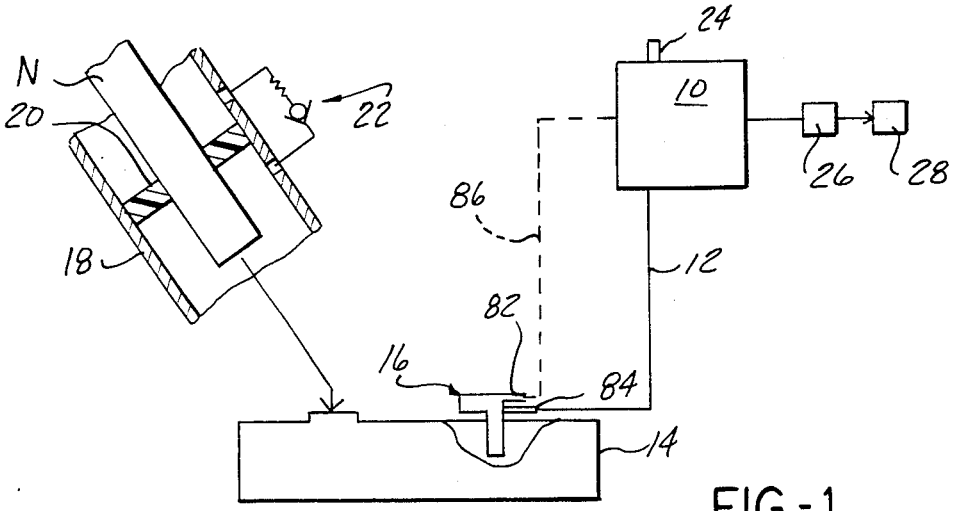

The present invention is directed to onboard fuel vapor recovery systems employed on motor vehicles to prevent or minimize the discharge of fuel vapor from the vehicle fuel tank into the atmosphere. The head space in the fuel tank of a motor vehicle must be vented to atmosphere to equalize the pressure in the head spaced as fuel is withdrawn from the tank by operation of the vehicle engine.

For many years, this venting was accomplished by a simple vent in the closure cap of the fuel tank fill pipe; more recently, this venting is performed through a charcoal filled vapor canister vented to atmosphere and also connected via a socalled purge system to the intake manifold of the vehicle engine so that fuel vapor can be withdrawn from the canister at a controlled rate for combustion in the engine. The rate at which vapor is withdrawn from the canister for combustion by the purge system is carefully controlled to a limited rate to avoid overly enriching the normal fuel mixture, and the rate at which pressure equalizing flow from the vent into the tank occurs to compensate for fuel consumption is minimal. Thus, these systems employ relatively restricted flow passages to minimize the possible discharge of fuel vapor from the canister vent.

Such systems are totally inadequate to cope with the massive surge of fuel vapor displaced from the fuel tank by incoming fuel during a refueling operation and the vapor displaced during refueling is normally discharged into the atmosphere through the fill pipe inlet.

In a commonly owned co-pending application Ser. No. 07/101,069, filed Sept. 25, 1987, there are disclosed vapor recovery systems designed to recover and store fuel vapor displaced from the tank during the refueling operation. In essence, these last systems employ two canisters connected in parallel with each other between the fuel tank and purge systemnamely a relatively small "running vapor" canister vented to atmosphere and connected to the fuel tank at all times via a relatively restricted conduit (the system described above), and a relatively large "refueling vapor" canister connected by a relatively unrestricted conduit to the fuel tank only while the vehicle is being refueled. The systems described in the aforementioned co-pending application utilize a refueling vapor valve opened either electrically or mechanically in response to the insertion of a service station fuel pump nozzle into the fill pipe to place the tank in communication with the large "refueling vapor" canister.

When the nozzle is removed at the conclusion of the refueling operation, the valve automatically closes. The refueling vapor system also includes a float valve responsive to the level of fuel in the tank which will closes to disconnect the refueling vapor recovery system from the tank when the fuel level in the tank rises to a predetermined level.

The present invention is directed to a refueling vapor recovery system which may, if desired, employ only a single canister connected to the head space of the fuel tank in a manner such that substantially unrestricted flow of vapor from the tank to the canister can occur during a refueling operation while the flow of vapor from the tank to the canister is limited or restricted at all other times. The system utilizes a single pressure responsive valve of relatively compact construction which may be mounted directly upon the fuel tank of the vehicle.

SUMMARY OF THE INVENTION

In a system embodying the present invention, a valve housing is sealingly mounted upon and projects through the top wall of the vehicle fuel tank. A tubular extension on the bottom of the housing projects vertically downwardly into the interior of the fuel tank and an inlet passage extends upwardly from the top of this extension through the housing to open at its upper end into the bottom of an internal cavity within the housing. A flexible diaphragm is sealed around its periphery to the housing and extends across the cavity to divide the cavity into an upper and a lower chamber. An outlet passage extends from this lower chamber through the housing wall and is connected via a relatively unrestricted flow conduit to a vapor receiving canister. The upper chamber above the diaphragm is vented to atmosphere and the diaphragm is flexed vertically in response to the difference between atmospheric pressure in the upper chamber and the pressure which exists in the inlet passage and lower chamber below the diaphragm. The inlet passage enters the lower chamber through a valve port centered beneath the diaphragm, and downward flexing movement of the diaphragm will seat the diaphragm upon this port to block communication between the inlet passage and lower chamber. A compression spring biasses the diaphragm downwardly so that vapor can flow from the inlet passage into the lower chamber, and thence via the outlet to the vapor canister, only when the pressure in the inlet passage exceeds atmospheric pressure by an amount sufficient to overcome the bias of the spring force.

The upper chamber is connected via a bypass passage controlled by a one-way check valve to the head space in the tank, the check valve permitting flow from the upper chamber into the tank when the pressure in the tank head space drops below a predetermined subatmospheric pressure.

The tubular extension of the housing loosely receives a float valve which normally is unseated to place the inlet passage in communication with the heat space of the tank. During a refueling operation, the level of fuel within the tank will eventually arise to a level which elevates the float valve to a sealed position, blocking the inlet passage to the diaphragm from the tank. The consequent increase in pressure in the heat space of the tank will cause fuel to back up in the fill pipe to trigger the automatic shuttoff incorporated in the standard fuel dispensing nozzle employed in service station fuel pumps. The fill pipe is provided with an annular seal which will seal around the fuel dispensing nozzle during the refueling operation to permit the nozzle to dispense fuel into the tank while sealing the upper end of the fill pipe against the discharge of fuel vapor from the fill pipe.

The system includes two emergency pressure relief valves which will function to relieve pressure in the tank and fill pipe in the event the automatic nozzle shutoff does not function and the incoming flow of fuel is not stopped upon filling of the tank. The first of these emergency pressure relief valves is located in the fill pipe neck and takes the form of a one-way check valve controlled passage which bypasses the nozzle seal. This valve will open at a predetermined pressure in the fill pipe and permit fuel to spill form the fill pipe.

A second emergency pressure relief valve is located in the float valve and will open when the internal tank pressure exceeds the pressure at which the bypass valve in the fill pipe opens to place the tank in communication with the inlet passage in the vapor control valve described above.

Other objects and features of the invention will become apparent by reference to the following specification and to the drawings.

IN THE DRAWINGS

Figure 2:
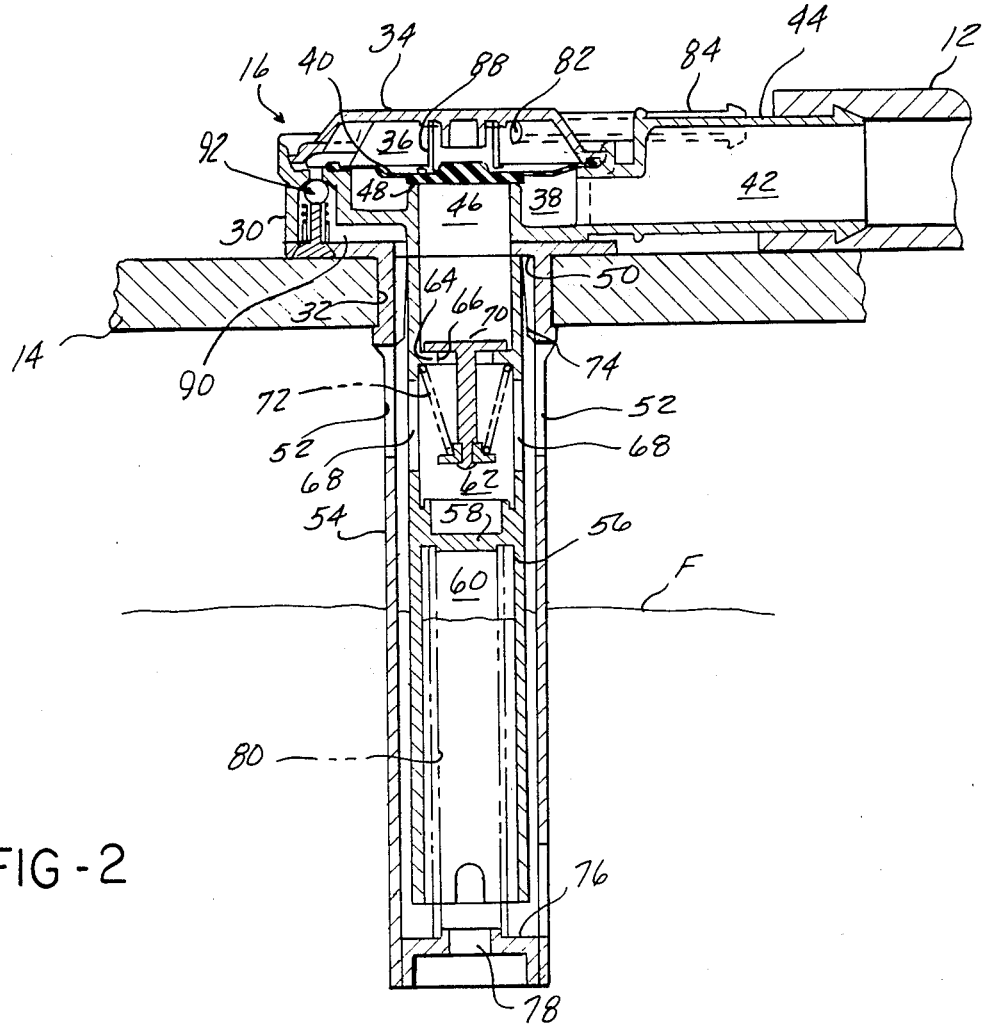

FIG. 1 is a schematic diagram of one form of system embodying the present invention; and FIG. 2 is a detail cross-sectional view of the tank valve employed in the system of FIG. 1.

Referring first to FIG. 1, one form of fuel vapor recovery system embodying the present invention finds a vapor storage canister 10 connected via a relatively large diameter conduit 12 to the head space of a vehicle fuel tank 14 via a tank valve 16. Fuel tank 14 is provided with a fill pipe partially indicated at 18 which is adapted to receive a fuel dispensing nozzle N of a conventional service station fuel pump, not shown. An annular seal 20 mounted in the interior of fill pipe 18 is dimensioned to slidably and sealingly receive the nozzle, which is of a standard outer diameter, so that fuel may be dispensed from the nozzle into the fuel tank while the open upper end of the fill pipe 18 is sealed against the discharge of vapor from the fill pipe into the atmosphere. An emergency pressure relief bypass designated generally 22 is schematically illustrated and functions to bypass fuel from fill pipe 18 around seal 20 to permit excess fuel to spill from the open end of the fill pipe if the nozzle is not shut off promptly enough when the tank is completely filled. Standard nozzles N in present day use conventionally include an automatic shutoff device actuated by a backup of fuel in fill pipe 18 when the tank is filled. In the event of malfunction of the automatic shutoff device or if the nozzle is not shut off manually in time, the buildup of pressure within the fill pipe will open relief valve 22 at a predetermined pressure.

The vapor canister 10 is provided with a relatively small atmospheric vent 24 and is connected via a schematically illustrated purge system 26 to the intake manifold of the vehicle engine schematically indicated at 28. When the engine is running, vacuum is developed in the intake manifold and, under the control of purge system 26, will withdraw vapor from canister 10 at a controlled rate for mixture with the normal fuel mixture supplied to the engine via the intake manifold. Purge systems for accomplishing this purpose are known in the art.

Details of tank valve 16 are shown in FIG. 2. Valve 16 includes a housing 30 fixedly mounted upon the top wall of fuel tank 14 and projecting downwardly through an opening 32 in the top wall to which the housing is sealed by conventional means, not shown.

At the upper end of housing 30, an internal cavity cooperatively defined by housing 30 and housing cap 34 is divided into an upper chamber 36 and a lower chamber 38 by a flexible diaphragm 40 sealingly clamped around its outer periphery between cap 34 and housing 30. Lower chamber 38 opens at one side into an outlet passage 42 which extends through a hose coupling 44 coupled to conduit 12 which leads to canister 10.

An inlet passage 46 extends downwardly through an annular valve seat 48 projecting upwardly from the bottom of chamber 38 past a downwardly facing radial shoulder 50 to open into the head space of fuel tank 14 via openings 52 in the sidewall of an elongate hollow tubular extension 54 of housing 30. A hollow tubular float member 56 open at its upper and lower ends is loosely received within tubular extension 54. A transverse partition 58 divides the interior of float member 56 into a float chamber 60 opening at the lower end of float member 56 and a valve chamber 62 located above partition 58. A second transverse partition 64 at the upper end of valve chamber 62 is formed with a central passage 66 constituting an outlet from chamber 62 to the open upper end of member 56. Openings 68 through the wall of float member 56 place chamber 62 in constant communication with the interior of tank 14. The upper end of passage 66 is normally closed by a valve head 70 resiliently biassed downwardly against the top of partition 64 by a compression spring 72.

The upper end of float member 56 is open and is slidably guided in vertical movement relative to housing 30 as by ribs 74. The upper end of float member 56 is engageable with the downwardly facing shoulder 50 on housing 30 to seal inlet passage 46 from the interior of tank 10 when the level of fuel F in tank 10 is at a level such that air trapped in float chamber 60 lifts the float upwardly to the position shown in FIG. 2. This level of fuel within the tank constitutes the "tank full" level. When the tank is only partially full, float member 56 is lowered clear of shoulder 50 to place the read space in tank 10 in communication with passage 46. Float 56 normally rests upon an end cap 76 fixedly mounted in the lower end of tubular extension 54. End cap 76 is formed with a thru passage 78 to permit fuel to flow into the bottom of tube 54 when the float member is seated on cap 76.

A relatively light rollover spring 80 is engaged between cap 76 and partition 58 of float member 56. The characteristic of spring 80 is such that when tube 54 is at or close to a truly vertical position, the weight of float member 50 is substantially counterbalanced by spring 80. When tube 54 is tilted in any direction by more than a predetermined angle, the reduced vertical component of the weight of float member 50 enables spring 80 to shift float member 56 upwardly to seal passage 46 from the interior of tank 14. This action prevents the escape of fuel and fuel vapor from tank 14 in the event of a vehicle rollover.

Upper chamber 36 above diaphragm 40 is formed with an outlet opening 80 which extends through a second relatively small diameter hose coupling 84. Hose coupling 84 may either be vented directly to atmosphere as indicated in FIG. 1 or it may be connected via a relatively small diameter conduit indicated in broken line at 86 in FIG. 1 to canister 10. In either case, the function of outlet 82 is to maintain atmospheric pressure in upper chamber 36 above diaphragm 40. A compression spring 88 engaged between cap 34 and the top of diaphragm 40 normally biasses diaphragm 40 downwardly into the position shown in FIG. 2 where the diaphragm engages valve seat 48 and seals inlet passage 46 from lower chamber 38.

When float member 56 is lowered from the position shown in FIG. 2—that is when tank 14 is not filled with fuel-vapor in the head space of tank 14 can flow into inlet passage 46 past the opened float valve. When the pressure in inlet passage 46 rises above atmospheric pressure by an amount sufficient to overcome the biassing action of spring 88, the diaphragm will be lifted clear of valve seat 48 and vapor can flow from inlet passage 46 into chamber 38 and thence to canister 10. The compressive force of spring 88 is relatively light and typically will permit diaphragm 40 to disengage from valve seat 48 when the pressure in inlet passage 46 is about two inches of water above atmospheric.

In the event pressure in the head space of tank 14 should drop below atmospheric pressure, upper chamber 36 is placed in communication with the head space of the tank via a bypass passage 90 opening into the head space of the tank. A one-way ball check valve 92 normally closes this passage, but is oriented to open when the pressure in the head space of tank 14 drops below a predetermined sub-atmospheric pressure, a typical setting for valve 92 being approximately 14 inches of water below atmospheric.

OPERATION

During normal operation of the vehicle, float 56 will be lowered from the position shown in FIG. 2 to place inlet passage 46 of valve 16 in direct communication with the head space of the tank via passage 46 and openings 52 in tubular extension 54. Chamber 36 above diaphragm 40 is maintained at atmospheric pressure and fuel vapor from the head space in tank 14 can flow from the tank through valve 16 to canister 10 at any time when the pressure of fuel vapor in the head space of tank 14 exceeds atmospheric pressure by an amount sufficient to overcome the bias of spring 88 and lift diaphragm 40 clear of valve seat 48 to permit fuel vapor to flow from the tank into canister 10. As stated above, the biassing action of spring 88 is quite light and diaphragm 40 will be lifted from seat 48 typically when the pressure in the head space of the fuel tank is approximately two inches of water above atmospheric.

In the event the pressure in the head space of tank 14 should drop below atmospheric pressure by a selected amount, typically about 14 inches of water less than atmospheric, valve 92 will open to place the head space in tank 14 in communication with atmospheric pressure in chamber 36.

In the even of a vehicle rollover, the consequent tilting of tubular extension 54 of the valve housing from the vertical enables rollover spring 80 to bias float member 56 to the seated position shown in FIG. 2 blocking communication between the head space of tank 14 and inlet passage 46 to prevent spillage of fuel or fuel vapor from the tank. Valve 92 is so oriented as to prevent flow from the tank.

Operation of the vehicle engine will withdraw fuel vapor from canister 10 for combustion in the engine at a rate controlled by purge system 26.

During refueling of the vehicle, a standard fuel dispensing nozzle N of a service station pump is inserted into the inlet end of fill pipe 18 as shown in FIG. 1 and seals the tank side of the fill pipe from atmosphere and thus prevents the discharge of fuel vapor into the atmosphere from the fill pipe. As the tank is filled, the rising level of fuel within the tank displaces fuel vapor from the head space of the tank, the pressure in the head space of tank 14 during the refueling operation being sufficient to maintain diaphragm 40 clear of valve seat 48 so that the displaced vapor can flow freely from the tank into canister 10 via conduit 12.

Canister 10 is typically filled with a vapor absorbent material, such as charcoal, and is designed with a capacity sufficient to receive and store all of the fuel vapor displaced from the tank during a refueling operation. Typically, the capacity of canister 10 will be from three to four liters, but may vary from these capacities in accordance with the capacity of the vehicle fuel tank.

Continuing flow of fuel from nozzle N into the fuel tank will eventually lift float member 56 upwardly until the float seats in the closed position shown in FIG. 2, blocking further discharge of fuel vapor from tank 14 into the upper end of inlet passage 46. Continuing flow of fuel into the tank will cause an increase in pressure in the head space of tank 14 which will cause a back up of fuel in fill pipe 18 to trigger the automatic nozzle shutoff device incorporated inmost present day service station fuel pump nozzles.

Should the nozzle not be equipped with such an automatic shutoff device or in the event the automatic shutoff device should malfunction, continued flow of fuel form the nozzle N will cause the pressure in tank 14 and fill pipe 18 to continue to rise until the emergency pressure relief bypass 22 is actuated to permit fuel from fill pipe 18 to bypass seal 20 and spill from the open end of the fill pipe. In the event the nozzle N is not manually shut off or removed from fill pipe 18 in response to this spillage, if the continued rate of flow of fuel from nozzle N exceeds the flow capacity of bypass 22, pressure within the fill pipe and tank 14 will continue to rise unto the biassing action of spring 72 of emergency pressure relief valve 70 in float member 56 is overcome to vent fuel tank 14 past the float valve and into inlet passage 46. The setting of emergency pressure relief valve 70 is such that it would open only in an emergency situation in which a relatively high volume rate of flow of fuel from nozzle 10 should continue will after spillage of fuel from the fill pipe inlet commenced.

While the overfilling of the fuel tank due to a nozzle shut-off malfunction is the most likely event to actuate the emergency pressure relief valve 70, it is believed apparent this valve will open to relieve excess pressure from tank 14 regardless of the cause of the excess pressure.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

We claim:

1. In a vehicle mounted fuel vapor recovery system for receiving fuel vapor from the head space of the fuel tank of the vehicle and feeding said vapor at a controlled rate to the vehicle engine for combustion therein, said system including canister means for receiving and storing fuel vapor, purge means for withdrawing vapor from said canister at a controlled rate for combustion in said engine, and valve means for controlling the flow of vapor between said fuel tank and said canister means;

the improvement wherein said valve means comprises a valve housing having inlet passage means opening into the head space in said fuel tank and outlet passage means in direct substantially unrestricted communication with said canister means, pressure responsive means in said housing for placing said inlet passage means in communication with said outlet passage means when the pressure in said inlet passage means exceeds a predetermined pressure and for blocking communication between said inlet passage means and said outlet passage means when the pressure in said inlet passage means falls below said predetermined pressure, and float valve means responsive to the level of fuel within said tank for sealing said inlet passage means from the head space in said tank when the level of fuel within said tank exceeds a predetermined level, said pressure responsive means comprising a flexible diaphragm mounted in said housing to divide a cavity within said housing into a first chamber and a second chamber sealed from each other by said diaphragm, said inlet passage means including an inlet port opening into said first chamber and said outlet passage means including an outlet port opening into said first chamber, vent means venting said second chamber to atmosphere, and biasing means for biasing said diaphragm into overlying sealed relationship to said inlet port when the pressure in said inlet passage means is less than said predetermined pressure, and bypass means in said housing for placing said second chamber in communication with the head space of said tank when the pressure in said head space is at or below a predetermined sub-atmospheric pressure.

2. In a vehicle mounted fuel vapor recovery system for receiving fuel vapor from the head space of the fuel tank of the vehicle and feeding the vapor at a controlled rate to the vehicle engine for combustion therein, said fuel tank including a fill pipe having a fill pipe inlet adapted to receive the tubular fuel dispensing nozzle of a conventional service station fuel pump which nozzle includes an automatic shutoff device for terminating the dispensing of fuel from said nozzle in response to a back up of fuel in said fill pipe, said recovery system including canister means for receiving fuel vapor from the head space of said tank, purge means for withdrawing fuel vapor from said canister means at a controlled rate for combustion in said engine, and valve means for controlling the flow of fuel vapor from said tank to said canister means;

the improvement wherein said valve means comprises a valve housing sealingly mounted upon and projecting through the top of said fuel tank, first means defining an internal cavity in said housing, a flexible diaphragm sealed around it periphery to said housing and extending across said cavity ot divide said cavity into an upper and a lower chamber sealed from each other by said diaphragm, vent means venting said upper chamber to atmosphere second means defining an inlet passage in said housing opening at its lower end into the head space of said tank and opening at its upper end through an inlet port into said lower chamber beneath said diaphragm, third means defining an outlet from said lower chamber in direct communication with said canister means, spring means resiliently biassing said diaphragm into overlying engagement with said inlet port to normally seal said first chamber from said inlet passage and accommodating upward movement of said diaphragm away from said inlet port when the pressure in said inlet passage exceeds a predetermined first pressure, seal means in said fill pipe inlet engageable with said fuel dispensing nozzle to seal said fill pipe into the atmosphere while said tank is being refilled with fuel dispensed from said nozzle, and float valve means in said tank for sealing said inlet passage in said housing from the head space of said tank when the level of fuel within said tank is above a predetermined level.

3. The invention defined in claim 2 further comprising bypass means in said housing for placing said upper chamber in communication with the head space of said tank when the pressure in said head space is at or below a predetermined sub-atmospheric pressure.

4. The invention defined in claim 2 wherein said housing further comprises a vertically elongate hollow tube fixed to and extending vertically downwardly from said housing into the interior of said tank, said tube having openings therein placing the interior of said tube in fluid communication with said head space and said inlet passage opening at its lower end into the interior of said tube through a downwardly facing valve seat on said housing, said float valve means comprising a hollow tubular float member loosely received in said tube for vertical sliding movement within said tube, means defining a float chamber in the lower end of said float member, and seat engaging means at the upper end of said float member engageable with said valve seat to seal said inlet passage from the head space in said tank.

5. The invention defined in claim 4 further comprising means defining a relief passage in said float member open at one end to the head space of said tank and opening at its other end centrally of said seat engaging means, and emergency pressure responsive valve means in said relief passage operable when said seat engaging means is engaged with said valve seat to vent the head space in said tank into said inlet passage when the pressure in said tank exceeds a predetermined emergency pressure.

6. The invention defined in claim 4 further comprising rollover means for engaging said seat engaging means with said valve seat in response to a vehicle rollover condition.

7. An onboard fuel vapor recovery system for a motor vehicle having a fuel tank, a vapor storage canister and an engine with a vapor conduit therebetween, said system comprising a pressure-responsive valve assembly mounted directly on said fuel tank so as to be free of a vapor inlet conduit and adapted to control the flow through said vapor conduit from said tank to said vapor storage canister both during normal operation of said engine and during a vehicle refueling operation, said pressure responsive tank-mounted valve assembly being constructed and arranged with a single diaphragm valve adapted to open a substantially unrestricted vapor flow passage extending from the head space of said tank to said canister when the head space pressure slightly exceeds atmospheric pressure and with a separate passage adopted to equalize pressure in the tank head space upon withdrawal of fuel from said tank, said valve assembly also having a float valve responsive to the level of fuel within said tank adopted to seal said vapor conduit passage from the tank head space when said tank is filled with fuel and an emergency tank pressure relief valve operable in the event of overfilling of said tank.

8. A system such as that recited in claim 7, wherein said valve assembly includes means for preventing escape of liquid fuel and/or vapor from said tank to said canister and/or the engine areas in the event of vehicle angularity and/or roll-over.

9. A system such as that recited in claim 8, wherein said valve assembly includes means for preventing rise of pressure in said tank above a predetermined maximum pressure.

10. A system such as that recited in claim 9 wherein said valve assembly is constructed and arranged so as to safely handle larger volumes (approximately 2.5 cfm) of fuel such as are generated during vehicle refueling and smaller volumes of vapor such as are generated during engine on or off conditions.

* * * * *